US008496074B2

(12) United States Patent
Nishikimi et al.

(10) Patent No.: US 8,496,074 B2
(45) Date of Patent: Jul. 30, 2013

(54) POWER TOOL

(75) Inventors: Junichi Nishikimi, Anjo (JP); Yasuhiro Kakiuchi, Anjo (JP)

(73) Assignee: Makita Corporation, Anjo-Shi (JP)

( * ) Notice: Subject to any disclaimer, the term of this patent is extended or adjusted under 35 U.S.C. 154(b) by 279 days.

(21) Appl. No.: 12/856,183

(22) Filed: Aug. 13, 2010

(65) Prior Publication Data

US 2011/0083868 A1 Apr. 14, 2011

(30) Foreign Application Priority Data

Oct. 14, 2009 (JP) ..... 2009-237523

(51) Int. Cl.
*B23B 45/02* (2006.01)

(52) U.S. Cl.
USPC ..... 173/171; 173/213

(58) Field of Classification Search
USPC ..... 173/171, 213, 162.1; 16/111.1, DIG. 12, 16/431; 310/71
See application file for complete search history.

(56) References Cited

U.S. PATENT DOCUMENTS

| | | | | |
|---|---|---|---|---|
| 3,413,498 | A * | 11/1968 | Bowen, III et al. | 310/47 |
| 3,652,879 | A * | 3/1972 | Plunkett et al. | 310/50 |
| 3,703,646 | A * | 11/1972 | Jacyno | 310/47 |
| 3,911,304 | A * | 10/1975 | Seely | 310/242 |
| 6,823,562 | B1 | 11/2004 | Smith et al. | |
| 2006/0021193 | A1 | 2/2006 | Yu Chen | |
| 2007/0000677 | A1 * | 1/2007 | Nakashima et al. | 173/217 |
| 2007/0246237 | A1 | 10/2007 | Homsi et al. | |
| 2007/0256847 | A1 | 11/2007 | Wan et al. | |

FOREIGN PATENT DOCUMENTS

| | | | |
|---|---|---|---|
| DE | 10 2006 020 172 | A1 | 11/2007 |
| EP | 1 184 137 | A2 | 3/2002 |
| EP | 1 479 486 | A2 | 11/2004 |
| JP | Y2-3-16172 | | 4/1991 |

OTHER PUBLICATIONS

Extended Search Report issued in European Patent Application No. 10174662.6 dated Jan. 21, 2011.

* cited by examiner

*Primary Examiner* — Alexandra Elve
*Assistant Examiner* — Nathaniel Chukwurah
(74) *Attorney, Agent, or Firm* — Oliff & Berridge, PLC

(57) ABSTRACT

In a power tool, a housing is composed of two divisional housings to be combined together; two receptacle blocks are provided on inner surfaces of the two divisional housings, respectively, and configured to protrude opposite to each other from the inner surfaces of the two divisional housings to surround an electric component and to hold the electric component in place when the two divisional housings are combined together into the housing; and a seal layer of an elastic material is formed integrally with one or each of the two receptacle blocks. The seal layer formed on a first receptacle block is pressed against a second receptacle block or another seal layer formed on the second receptacle block to provide sealing between opposed surfaces of the two receptacle blocks when the two divisional housings are combined together.

19 Claims, 4 Drawing Sheets

POWER TOOL

BACKGROUND OF THE INVENTION

This application claims the entire benefit of Japanese Patent Application Number 2009-237523 filed on Oct. 14, 2009, the entirety of which is incorporated by reference.

TECHNICAL FIELD

This invention relates to a power tool comprising a housing composed of two divisional housings to be combined together, and receptacle blocks provided on inner surfaces of the two divisional housings respectively and configured to protrude therefrom opposite to each other so as to surround an electric component, and to hold the electric component in place when the two divisional housings are combined together into the housing.

BACKGROUND ART

In a power tool of various kinds, typically, when an electric component is to be housed in its housing composed of two divisional housings, a seal material made of rubber or the like is adhered to the abutting end faces of the two divisional housings to remove an interstice therebetween, in order to provide waterproof and dustproof constructions for the electric component.

Another attempt has been made to adopt a waterproofed electric component in order to proactively address the problem of insufficient sealing for the electric component.

Besides, an example of a power tool which adopts a waterproof structure for a switch through which electric operation is performed is known in the art as disclosed in Japanese Examined Utility Model Application Publication No. 3-16172 (Y2). In this example, an operation part of the switch is exposed through an opening, the operation part is covered from outside by a waterproof rubber member, and a collar is provided by which the waterproof rubber member is pressed in a groove formed at an inner edge of the opening.

However, if the two divisional housings were combined without having a seal material adhered appropriately to the abutting end faces, interstices allowing entry of water or dust would develop. Thus, there is apprehension that the waterproof and dustproof properties for the electric component could possibly be diminished.

Moreover, electric components waterproofed as described above may generally be expensive. Therefore, it is also apprehended that the use of a waterproofed electric component should entail an increase in the manufacturing cost of the power tool.

Thus, the present invention is to provide a power tool which is excellent in waterproof and dustproof properties for an electric component housed in its housing composed of two divisional housings, which excellence is achieved without increasing the manufacturing cost thereof.

SUMMARY OF INVENTION

It is an aspect of the present invention to provide a power tool comprising:

a housing composed of two divisional housings to be combined together;

two receptacle blocks provided on inner surfaces of the two divisional housings, respectively, and configured to protrude opposite to each other from the inner surfaces of the two divisional housings to surround an electric component and to hold the electric component in place when the two divisional housings are combined together into the housing; and a seal layer of an elastic material, formed integrally with one or each of the two receptacle blocks, wherein the seal layer formed on a first receptacle block is pressed against a second receptacle block or another seal layer formed on the second receptacle block to provide sealing between opposed surfaces of the two receptacle blocks when the two divisional housings are combined together.

In a second aspect of the present invention, in accordance with the first aspect, outer surface layers of an elastic material may be formed on outer surfaces of the two divisional housings, respectively, and the seal layer may be configured to pierce a divisional housing from the inside of the receptacle block, and to be continuously formed integrally with one of the outer surface layers formed on the divisional housing.

In a third aspect of the present invention, in accordance with the first aspect and/or second aspect, the seal layer may include a first seal layer formed on the first receptacle block and a second seal layer formed on the second receptacle block, and the first and second seal layers may be configured to be pressed against each other when the two divisional housings are combined together.

Various configurations according to the present invention may be put into practice and achieve one or more advantageous effects as follows:

According to the configuration described above in the first aspect, an electric component is surrounded by the two receptacle blocks and the seal layer formed integrally with at least one of the two receptacle blocks serves to provide sealing between opposed surfaces of the two receptacle blocks when the two divisional housings are combined together. Therefore, the power tool is securely sealed at the opposed surfaces of the two receptacle blocks and thus rendered excellent in dustproof and waterproof properties for the electric component.

Furthermore, the waterproof property provided for the electric component by the seal layer as described above may obviate the need to use an expensive waterproofed electric component. As a result, the increase in the manufacturing cost for the power tool can be prevented.

According to the configuration with the additional feature described above in the second aspect, the seal layer does not have to be fabricated independently of an outer surface layer formed on an outer surface of the divisional housing on which the one or each of the two receptacle blocks is formed integrally with the seal layer, and thus can be formed simultaneously with the outer surface layer. This makes it possible to streamline the forming or molding operation and to reduce the number of parts to be formed.

According to the configuration with the additional feature described above in the third aspect, the first and second seal layers of an elastic material are deformed and brought into hermetical contact with each other when the two divisional housings are combined together. Therefore, the electric component is surrounded by the two receptacle blocks and provided with an improved capability of sealing between the first and second seal layers, so that the dustproof and waterproof properties for the electric component can be enhanced.

BRIEF DESCRIPTION OF THE DRAWINGS

The above aspect, other advantages and further features of the present invention will become more apparent by describing in detail illustrative, non-limiting embodiments thereof with reference to the accompanying drawings, in which.

DESCRIPTION OF EMBODIMENTS

First Embodiment

Figure 1:
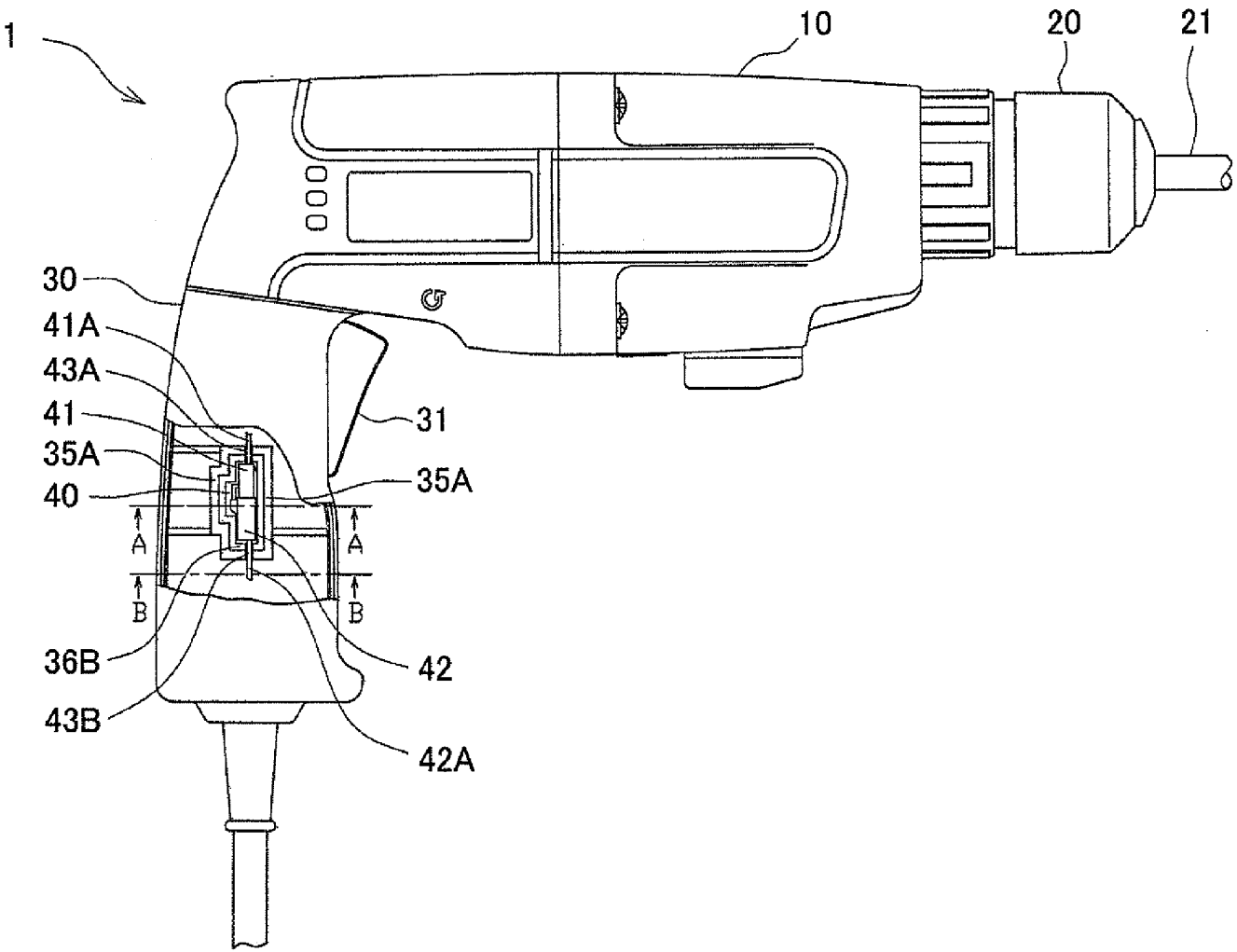
FIG. 1 is a side view of a hammer drill according to an exemplary embodiment of the present invention.

A first embodiment of the present invention will be described hereinafter with reference to FIGS. 1, 2A and 2B. A hammer drill 1 shown in FIG. 1 includes a main body housing 10, a drill chuck 20, and a handle 30. The hammer drill 1 is one example of a power tool consistent with the present invention.

The main body housing 10 is made of plastic and shaped in a tubular form. The main body housing 10 accommodates a motor, a rotation transmission mechanism, and other components.

The drill chuck 20 is provided at a front end of the main body housing 10 and configured to protrude therefrom frontward of the main body housing 10. The drill chuck 20 is mounted on a tool holder (not shown) which protrudes frontward from the main body housing 10. At a front end of the drill chuck 20, a drill bit 21 is detachably installed to the drill chuck 20.

The handle 30 is configured to be able to be vertically separable into two, left and right halves. As shown in FIGS. 2A and 2B, the handle 30 is composed of a first left handle portion 30L made of plastic and a second right handle portion 30R made of plastic, which are abutted on each other and combined together. The handle 30 is screwed on a lower side of a rear end portion of the main body housing 10 so that the handle 30 protrudes downward from the rear end portion of the main body housing 10. Denoted by reference character 31 is a switch lever for operation of an ON-Off which will be described later. The first left handle portion 30L and the second right handle portion 30R are exemplary of two divisional housings consistent with the present invention.

Figure 2A:
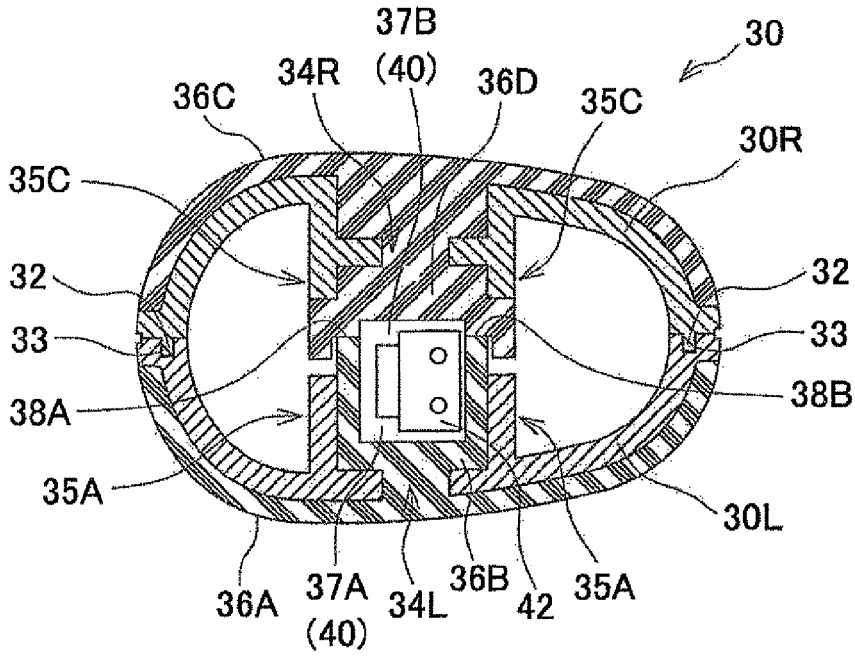
FIG. 2A is a cross-sectional view of a principal portion of the hammer drill according to a first embodiment, as taken along line A-A of FIG. 1.
Figure 2B:
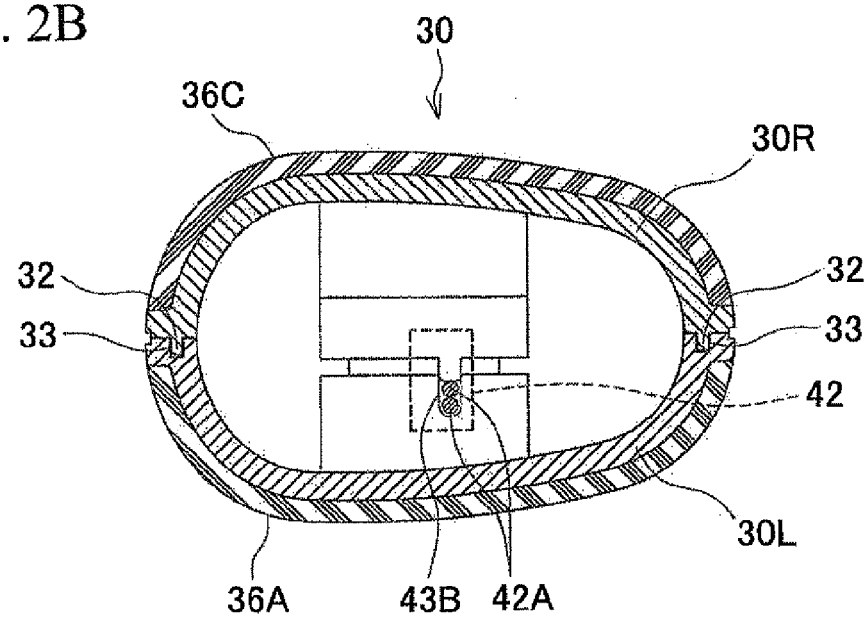
FIG. 2B is a cross-sectional view of a principal portion of the hammer drill according to the first embodiment, as taken along line B-B of FIG. 1.

As shown in FIGS. 2A and 2B, locator ridges 32 are formed on front and rear end faces, both facing leftward, of the second right handle portion 30R. On the other hand, locator channels 33 are formed on front and rear end faces, both facing rightward, of the first left handle portion 30L. As will be described later, the front and rear locator ridges 32 are fitted in the front and rear locator channels 33, respectively.

As shown in FIG. 2A, the first left handle portion 30L has an opening 34L configured to pierce the first left handle portion 30L. On an inner surface of the first left handle portion 30L, a receptacle block 35A is provided and configured to protrude inward from the inner surface of the first left handle portion 30L. The receptacle block 35A includes opposed wall portions disposed with a predetermined distance separate from each other in the front-rear direction of the handle 30 (i.e., the left-right direction of FIG. 2A). As shown in FIG. 2A, one of the wall portions of the receptacle block 35A is shaped substantially like a letter L and the other of the wall portions of the receptacle block 35A is shaped substantially like an inversed letter L; thus, the receptacle block 35A are configured to surround a male connector 41 and a female connector 42 which will be described later.

On an outer surface of the first left handle portion 30L, an outer surface layer 36A is provided. The outer surface layer 36A is made of elastomer as one example of an elastic material and formed on the outer surface of the first left handle portion 30L by double molding. The outer surface of the first left handle portion 30L is one example of an outer surface of a divisional housing consistent with the present invention.

Moreover, on an inner surface of the receptacle block 35A, a seal portion 36B is formed integrally with the receptacle block 35A by the aforementioned double molding. The seal portion 36B is continuously formed integrally with the outer surface layer 36A by pouring the above described elastomer (elastic material) into a mold. In this way, as shown in FIG. 2A, the seal portion 368 can be configured to extend from the inner surface of the receptacle block 35A, piercing through the opening 34L to the outside, and can thus be continuously formed integrally with the outer surface layer 36A. In the seal portion 36B, a connector holding recess 37A for the connectors 41, 42 to be embedded therein is formed as shown in FIG. 2A.

As shown in FIG. 2A, the second right handle portion 30R has an opening 34R. The opening 34R is configured to pierce the second right handle portion 30R. On an inner surface of the second right handle portion 30R, a receptacle block 35C is provided and configured to protrude inward from the inner surface of the second right handle portion 30R. The receptacle block 35C includes opposed wall portions disposed with the same predetermined distance (as that between the wall portions of the receptacle block 35A) separate from each other in the front-rear direction of the handle 30. One of the wall portions of the receptacle block 35C is shaped substantially like a letter L and the other of the wall portions of the receptacle block 35C is shaped substantially like an inversed letter L, as viewed in a side elevation.

On an outer surface of the second right handle portion 30R, an outer surface layer 36C is provided, like the outer surface layer 36A provided on the outer surface of the first left handle portion 30L. On an inner surface of the receptacle block 35C, a seal portion 36D is formed integrally with the receptacle block 35C, like the seal portion 36B formed on the inner surface of the receptacle block 35A. As shown in FIG. 2A, the seal portion 36D is configured to extend from the inner surface of the receptacle block 35C, piercing through the opening 34R to the outside, and continuously formed integrally with the outer surface layer 36C. The outer surface of the second right handle portion 30R is one example of an outer surface of a divisional housing consistent with the present invention.

In the seal portion 36D, as shown in FIG. 2A, a connector holding recess 37B for the connectors 41, 42 to be embedded therein, and a step portion 38A, 38B are formed. The step portion 38A at the rear side is configured to extend from the connector holding recess 37B rearward of the handle 30 (to the left in FIG. 2A), and the step portion 38B at the front side is configured to extend from the connector holding recess 37B frontward of the handle 30 (to the right in FIG. 2A).

When the second right handle portion 30R is abutted on the first left handle portion 30L and the aforementioned locating ridge 32 is fitted into the aforementioned locator channel 33, the second right handle portion 30R is fixed to the first left handle portion 30L. This state in which the second right handle portion 30R is fixed to the first left handle portion 30L in this embodiment relates to the condition defined as "when the two divisional housings are combined together" according to the present invention.

As shown in FIG. 2A, in the present embodiment, when the second right handle portion 30R is fixed to the first left handle portion 30L, an end face of the seal portion 36B and a surface opposed thereto of the step portion 38A, 38B are pressed against each other. In this state, the end face of the seal portion 36B and the surface opposed thereto of the step portion 38A, 38B (seal portion 36D) are elastically deformed and brought into hermetical contact with each other, because the seal portions 36B, 36D are both formed of elastomer as described above. The seal portions 36B, 36D are exemplary of a seal layer ("first seal layer" and "second seal layer") consistent with the present invention. Sealing thus provided between the end face of the seal portion 36B and the surface opposed thereto of the step portion 38A, 38B of the seal portion 36D in the present embodiment relates to "sealing between opposed surfaces of the two receptacle blocks" according to the present invention. Moreover, the receptacle block 35A is one example of "first receptacle block" consistent with the present invention, while the surface opposed thereto of the step portion 38A, 38B relates to "another seal layer formed on the second receptacle block" consistent with the present invention.

When the end face of the seal portion 36B and the surface opposed thereto of the step portion 38A, 38B are in hermetical contact with each other, a connector holding space 40 for the connectors 41, 42 to be enclosed therein is formed by the connector holding recesses 37A and 37B. As shown in FIGS. 1 and 2A, a male connector 41 and a female connector 42 are connected with each other and housed in the connector holding space 40. In this way, the male connector 41 and the female connector 42 are held in place within the handle 30 by the receptacle block 35A, 35C with the seal portions 36B, 36D interposed therebetween. The male connector 41 and the female connector 42 are exemplary of an electric component consistent with the present invention.

As shown in FIGS. 1 and 2B, wire lead-in tunnels 43A, 43B (through holes) by means of which the connector holding space 40 communicates with outside is formed through the seal portion 36B (receptacle block 35A) and vertically extend upward and downward, respectively. A lead wire 41A connected with the male connector 41 is led from the inside of the connector holding space 40 to the outside of the connector holding space 40 (to an upper space inside the handle 30) through the wire lead-in tunnel 43A. In the upper space inside the handle 30, the ON-OFF switch (not shown) is provided, and the lead wire 41A is electrically connected with this ON-OFF switch.

A lead wire 42A connected with the female connector 42 is led from the inside of the connector holding space 40 to the outside of the connector holding space 40 (to a lower space inside the handle 30) through the wire lead-in tunnel 43B. In the lower space inside the handle 30, an AC adapter device (not shown) is provided with which this AC adapter is electrically connected. In the present embodiment as described above, the connector holding space 40 is formed with the end face of the seal portion 36B and the surface opposed thereto of the step portion 38A, 38B being in hermetical contact with each other; thus, no way for allowing of communication with the connector holding space 40 is formed except the interstices between the wire lead-in tunnel 43A and the lead wire 41A and between the wire lead-in tunnel 43B and the lead wire 42A. Accordingly the hermetic sealing property of the connector holding space 40 is enhanced. Consequently, even if water or dust enters the inside of the handle 30 through an interstice between the abutting end faces of the first left handle portion 30L and the second right handle portion 30R, entry of such water or dust into the connector holding space 40 can be prevented. Thus, the hammer drill 1 according to the present embodiment possesses improved waterproof and dustproof properties for the connectors 41, 42.

Moreover, in the present embodiment as described above, the male connector 41 and female connector 42 are held in place within the handle 30 by the receptacle blocks 35A, 35C with the seal portions 36B, 36D interposed between the connectors 41, 42 and the receptacle blocks 35A, 35C. Accordingly, even if vibrations are transmitted to the outer surface of the handle 30, the seal portions 36B, 36D absorb the vibrations to thereby reduce the vibrations transmitted to the connectors 41, 42. Therefore, the seal portions 36B, 36D serve to provide an improved vibration isolating effect for the connectors 41, 42.

Advantageous Effects of First Embodiment

In the hammer drill 1 according to the present embodiment, as described above, the seal portions 36B, 36D are formed on the inner surface of the receptacle blocks 35A, 35C, respectively, by double molding. Therefore, when the second right handle portion 30R is fixed to the first left handle portion 30L, the receptacle blocks 35A, 35C surround the connectors 41, 42 with the seal portions 36B, 36D interposed therebetween, and the end face of the seal portion 36B and the surface opposed thereto of the step portion 38A, 38B (seal portion 36D) formed on the inner surfaces of the receptacle blocks 35A, 35C, respectively, are elastically deformed and come in hermetical contact with each other. In this way, sealing can be provided between the end face of the seal portion 36B and the surface opposed thereto of the step portion 38A, 38B. Accordingly, the hammer drill 1 according to the present embodiment can have the connectors 41, 42 housed in the connector holding space 40 formed by the seal portions 36B, 36D, so that an improved sealing property can be achieved between the end face of the seal portion 36B and the surface opposed thereto of the step portion 38A, 38B, to thereby enhance the dustproof and waterproof properties for the connectors 41, 42.

Moreover, the waterproof property for the connectors 41, 42 can be ensured with the seal portions 36B, 36D, and thus no expensive waterproofed connector is necessary. Therefore, the increase in the manufacturing cost of the hammer drill 1 according to the present embodiment can be prevented.

Furthermore, as described above, the seal portion 36B is configured to extend from the inner surface of the receptacle block 35A, piercing through the opening 34L, and continuously formed integrally with the outer surface layer 36A. Therefore, the seal portion 36B does not have to be formed separately and independently of the outer surface layer 36A, and can be formed simultaneously with the outer surface layer 36A. In addition, as described above, the seal portion 36D is configured to extend from the inner surface of the receptacle block 35C, piercing through the opening 34R to the outside, and continuously formed integrally with the outer surface layer 36C. Therefore, the seal portion 36D does not have to be formed separately and independently of the outer surface layer 36C, and can be formed simultaneously with the outer surface layer 36C. Consequently, the forming and molding operation can be streamlined, and the number of parts to be formed can be reduced.

Second Embodiment

Figure 3A:
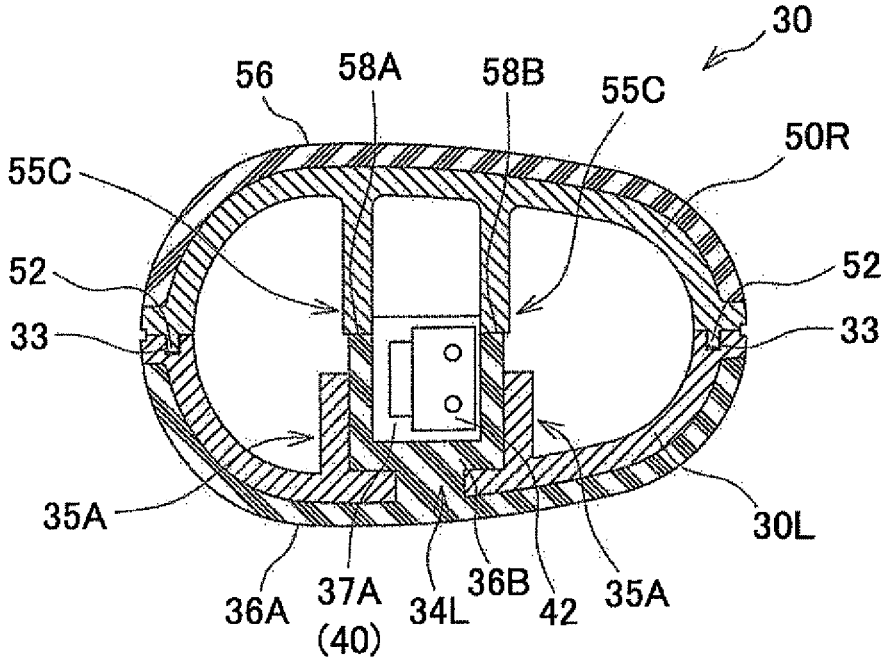
FIG. 3A is a cross-sectional view of a principal portion of the hammer drill according to a second embodiment, as taken along line A-A of FIG. 1.
Figure 3B:
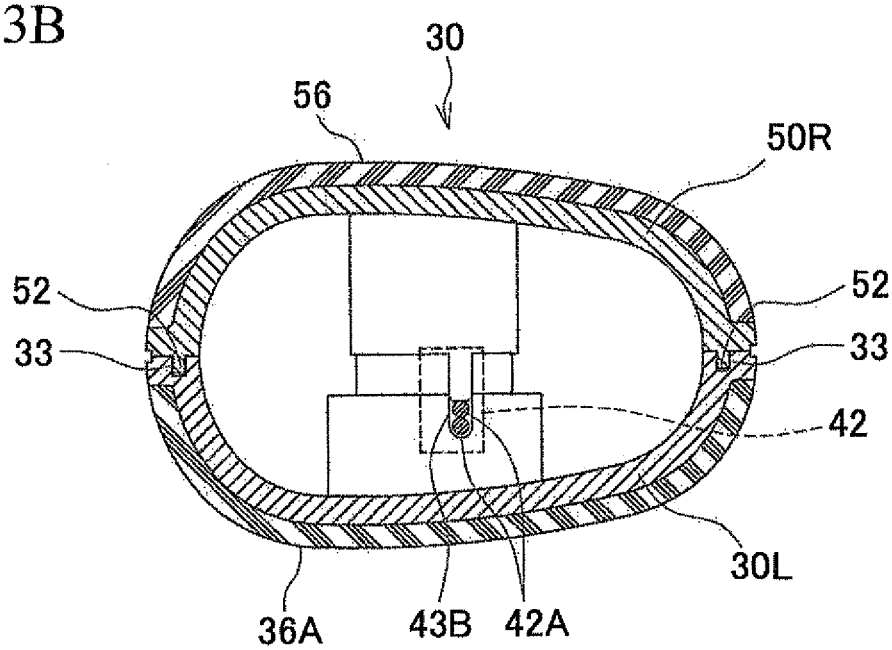
FIG. 3B is a cross-sectional view of a principal portion of the hammer drill according to the second embodiment, as taken along line B-B of FIG. 1.

A second embodiment of the present invention will be described hereinafter with reference to FIGS. 1, 3A and 3B. The same elements as in the first embodiment are designated by the same reference characters, and a duplicate description thereof will be omitted. As shown in FIGS. 3A and 3B, in the hammer drill 1 according to this embodiment, the second right handle portion 30R described above is replaced by a third right handle portion 50R. The third right handle portion 50R is formed of plastic and is one example of a divisional housing consistent with the present invention.

As shown in FIGS. 3A and 3B, locator ridges 52 are formed on front and rear end faces, both facing leftward, of the third right handle portion 50R. As will be described later, these front and rear locator ridges 52 are fitted in the front and rear locator channels 33, respectively.

As shown in FIG. 3A, on an inner surface of the third right handle portion 50R, a receptacle block 55C is provided and configured to protrude inward from the inner surface of the third right handle portion 50R. The receptacle block 55C includes opposed wall portions disposed with a predetermined distance (shorter than that between the wall portions of the receptacle block 35A) separate from each other in the front-rear direction of the handle 30. With the receptacle block 55C, the male connector 41 and the female connector 42 are surrounded partially.

On an outer surface of the third right handle portion 50R, an outer surface layer 56 is provided. The outer surface layer 56 is made of elastomer and formed on the outer surface of the third right handle portion 50R by double molding. The outer surface of the third right handle portion 50R is one example of an outer surface of a divisional housing consistent with the present invention.

In the present embodiment, the locator ridge 52 is fitted into the locator channel 33, and thereby the third right handle portion 50R is combined together with the first left handle portion 30L. In this state, as shown in FIG. 3A, the end face of the seal portion 36B is pressed against an end face 58A, 58B opposed thereto of a rib which makes up the receptacle block 55C, so that the end face of the seal portion 36B is elastically deformed and brought into hermetical contact with the end face 58A, 58B of the rib. Sealing thus provided between the end face of the seal portion 36B (integrally formed with the receptacle block 35A) and the end face 58A, 58B of the rib (of the receptacle block 55C) in the present embodiment relates to "sealing between opposed surfaces of the two receptacle blocks" according to the present invention. Moreover, the end face 58A, 58B relates to "second receptacle block" (against which the seal layer formed on a first receptacle block is pressed) consistent with the present invention.

Furthermore, in the present embodiment, when the end face of the seal portion 36B is brought into hermetical contact with the end face 58A, 58B of the rib, the connector holding space 40 is formed as shown in FIG. 3A by the connector holding recess 37A and the receptacle block 55C. The male connector 41 and the female connector 42 are held in place within the handle 30 by the receptacle block 35A and the receptacle block 55C with the seal portion 36B interposed between the receptacle block 35A and the receptacle block 55C.

In the present embodiment as described above, the connector holding space 40 is formed with the end face of the seal portion 36B and the end face 58A, 58B being in hermetical contact with each other; thus, the hermetic sealing property of the connector holding space 40 is enhanced, as in the above-described first embodiment. Accordingly, the hammer drill 1 according to the present embodiment possesses improved waterproof and dustproof properties for the connectors 41, 42, as in the above-described first embodiment.

Advantageous Effects of Second Embodiment

In the hammer drill 1 according to the present embodiment, as in the first embodiment, the seal portion 36B is formed on and integrally with the inner surface of the receptacle block 35A by double molding. Therefore, when the third right handle portion 50R is combined with the first left handle portion 30L, the receptacle blocks 35A, 55C surround the connectors 41, 42, and the end face of the seal portion 368 is elastically deformed and come in hermetical contact with the end face 58A, 58B of the rib (the receptacle block 55C). In this way, sealing can be provided between the end face of the seal portion 36B and the end face 58A, 58B. Accordingly, the hammer drill 1 according to the present embodiment can have the connectors 41, 42 housed in the connector holding space 40 formed by the seal portion 36B (connector holding recess 37A) and the receptacle block 55C, so that an improved sealing property can be achieved between the end face of the seal portion 36B and end face 58A, 58B, to thereby enhance the dustproof and waterproof properties for the connectors 41, 42.

Moreover, the waterproof property for the connectors 41, 42 can be ensured with the seal portion 36B, and thus an expensive waterproofed connector as used to ensure the waterproof property does not need to be provided. Therefore, the increase in the manufacturing cost of the hammer drill 1 according to the present embodiment can be prevented.

Third Embodiment

Figure 4A:
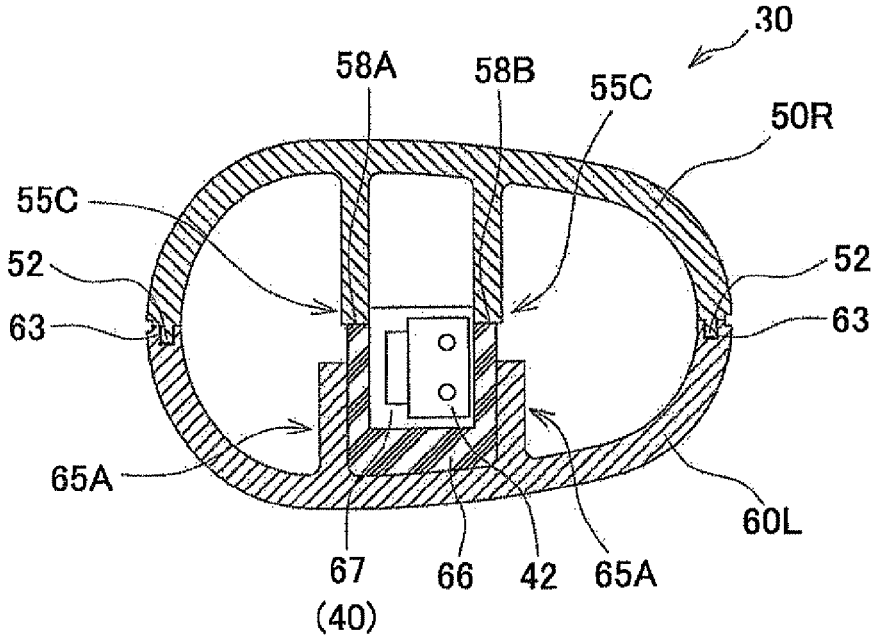
FIG. 4A is a cross-sectional view of a principal portion of the hammer drill according to a third embodiment, as taken along line A-A of FIG. 1.
Figure 4B:
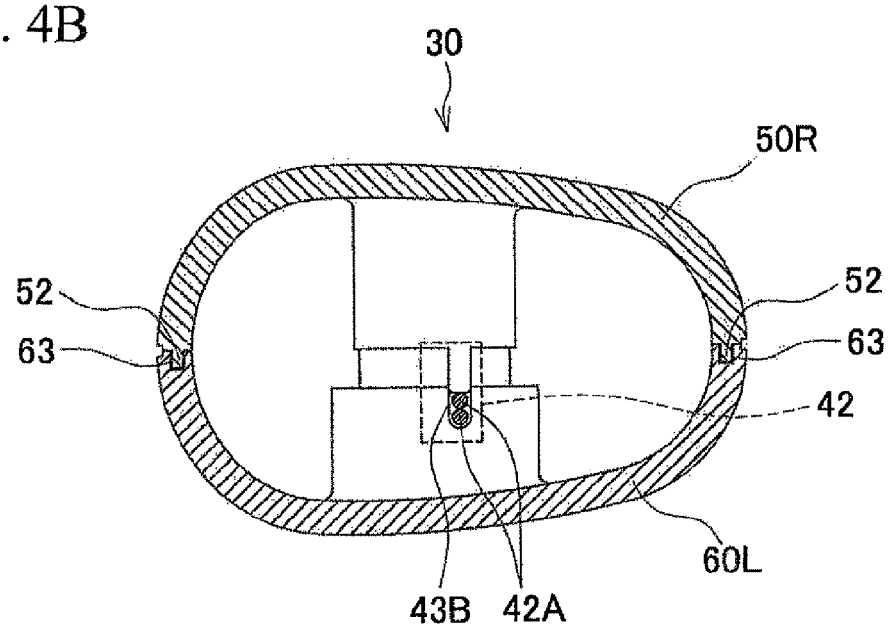
FIG. 4B is a cross-sectional view of a principal portion of the hammer drill according to the third embodiment, as taken along line B-B of FIG. 1.

A third embodiment of the present invention will be described hereinafter with reference to FIGS. 1, 4A and 4B. The same elements as in the first and second embodiments are designated by the same reference characters, and a duplicate description thereof will be omitted. As shown in FIGS. 4A and 4B, in the hammer drill 1 according to this embodiment, the first left handle portion 30L described above is replaced by a fourth left handle portion 60L. The fourth left handle portion 60L is formed of plastic, and additionally is one example of a divisional housing consistent with the present invention.

As shown in FIGS. 4A and 4B, locator channels 63 are formed on front and rear end faces, both facing rightward, of the fourth left handle portion 60L. The front and rear locator ridges 52 as in the second embodiment are fitted in these front and rear locator channels 63, respectively.

As shown in FIG. 4A, on an inner surface of the fourth left handle portion 60L, a receptacle block 65A is provided and configured to protrude inward from the inner surface of the fourth left handle portion 60L. The receptacle block 65A includes opposed wall portions disposed with a predetermined distance (longer than that between the wall portions of the receptacle block 55C) separate from each other in the front-rear direction of the handle 30. As shown in FIG. 4A, one of the wall portions of the receptacle block 65A is shaped substantially like a letter L and the other of the wall portions of the receptacle block 65A is shaped substantially like an inversed letter L. With the receptacle block 65A, the male connector 41 and the female connector 42 are surrounded. On an inner surface of the receptacle block 65A, a seal portion 66 made of elastomer is formed on the receptacle block 65A by double molding. In the seal portion 66, a connector holding recess 67 for the connectors 41, 42 to be embedded therein is formed.

In the present embodiment, the aforementioned locator ridge 52 is fitted into the locator channel 63, and thereby the third right handle portion 50R is combined together with the fourth left handle portion 60L. In this state, as shown in FIG. 4A, the end face of the seal portion 66 is pressed against the aforementioned end face 58A, 58B opposed thereto of the rib (receptacle block 55C), so that the end face of the seal portion 66 is elastically deformed and brought into hermetical contact with the end face 58A, 58B of the rib. The seal portion 66 is exemplary of a seal layer consistent with the present invention. Sealing thus provided between the end face of the seal portion 66 (integrally formed with the receptacle block 65A) and the end face 58A, 58B of the rib (of the receptacle block 55C) in the present embodiment relates to "sealing between opposed surfaces of the two receptacle blocks" according to the present invention.

Furthermore, in the present embodiment, when the end face of the seal portion 66 is brought into hermetical contact with the end face 58A, 58B of the rib, the aforementioned connector holding space 40 is formed as shown in FIG. 4A by the connector holding recess 67 and the receptacle block 55C. The male connector 41 and the female connector 42 are held in place within the handle 30 by the receptacle block 65A and the receptacle block 55C with the seal portion 66 interposed between the receptacle block 65A and the receptacle block 55C.

In the present embodiment as described above, the connector holding space 40 is formed with the end face of the seal portion 66 and the end face 58A, 58B being in hermetical contact with each other; thus, the hammer drill 1 according to the present embodiment possesses improved waterproof and dustproof properties for the connectors 41, 42, as in the above-described first and second embodiments.

Advantageous Effects of Third Embodiment

In the hammer drill 1 according to the present embodiment, the seal portion 66 is formed on and integrally with the inner surface of the receptacle block 65A by double molding, as described above. Therefore, when the third right handle portion 50R is combined with the fourth left handle portion 60L, the receptacle blocks 65A, 55C surround the connectors 41, 42, and the end face of the seal portion 66 is elastically deformed and come in hermetical contact with the end face 58A, 58B of the rib (the receptacle block 55C). In this way, sealing can be provided between the end face of the seal portion 66 and the end face 58A, 58B. Accordingly, the hammer drill 1 according to the present embodiment can have the connectors 41, 42 housed in the connector holding space 40 formed by the seal portion 66 (connector holding recess 67) and the receptacle block 55C, so that an improved sealing property can be achieved between the end face of the seal portion 66 and end face 58A, 58B, to thereby enhance the dustproof and waterproof properties for the connectors 41, 42.

Moreover, the waterproof property for the connectors 41, 42 can be ensured with the seal portion 66, and thus an expensive waterproofed connector as used to ensure the waterproof property does not need to be provided. Therefore, the increase in the manufacturing cost of the hammer drill 1 according to the present embodiment can be prevented.

The present invention is not limited to the above-described embodiments, and may be implemented with various modifications and changes made to part of their configurations as deemed appropriate without departing from the scope of the present invention. For example, in the above-described embodiments, the connectors 41, 42 are located in place within the handle 30 by the receptacle block 35A, 35C, 55C or 65A, and the seal portion 36B, 36D or 66 is provided to enhance the waterproof and dustproof properties for the connectors 41, 42. However, the present invention is not limited to this specific configuration. For example, any electric component other than the connectors 41, 42, such as the aforementioned ON-OFF switch, etc., may be located in place with in the handle 30 by the receptacle block 35A, 35C, 55C or 65A, and the seal portion 36B, 36D or 66 may be provided to enhance the waterproof and dustproof properties for the ON-OFF switch or other electronic components.

Moreover, in the above-described embodiments, the connectors 41, 42 provided with enhanced waterproof and dustproof properties are illustrated to be located in place within the handle 30, but the present invention is not limited to this specific configuration. For example, the receptacle block 35A, 35C, 55C or 65A and the seal portion 36B, 36D or 66 may be provided within the aforementioned main body housing 10, so that the waterproof and dustproof properties may be enhanced for connectors or any other electric component located in place within the main body housing 10.

Furthermore, in the above-described embodiments, the present invention is applied to the hammer drill 1 by way of example, but a power tool to which the present invention is applicable is not limited thereto; that is, the present invention is applicable to drills other than hammer drills, or any other types of power tool. In addition, the outer surface layer 36A, 36C or 56 and the seal portion 36B, 36D or 66 are formed by double molding (i.e., co-injection molding with a single nozzle) in the above-described embodiments, but the outer surface layer 36A, 36C or 56 and the seal portion 36B, 36D or 66 may be formed by two-dissimilar-material molding with two nozzles.

The invention claimed is:

1. A power tool comprising:

a housing composed of two divisional housings to be combined together;

two receptacle blocks provided on inner surfaces of the two divisional housings, respectively, and configured to protrude opposite to each other from the inner surfaces of the two divisional housings to surround an electric component and to hold the electric component in place when the two divisional housings are combined together into the housing; and a seal layer of an elastic material, formed integrally with one or each of the two receptacle blocks, wherein the seal layer formed on a first receptacle block is pressed against a second receptacle block or another seal layer formed on the second receptacle block to provide sealing between opposed surfaces of the two receptacle blocks when the two divisional housings are combined together, wherein the second receptacle block includes a rib having an end face configured to be opposed to the seal layer formed on the first receptacle block and to receive the seal layer formed on the first receptacle block that is pressed against the rib when the two divisional housings are combined together.

2. A power tool comprising:

a housing composed of two divisional housings to be combined together;

two receptacle blocks provided on inner surfaces of the two divisional housings, respectively, and configured to protrude opposite to each other from the inner surfaces of the two divisional housings to surround an entirety of an electric component and to hold the electric component in place when the two divisional housings are combined together into the housing; and a seal layer of an elastic material, formed integrally with one or each of the two receptacle blocks, wherein the seal layer formed on a first receptacle block is pressed against a second receptacle block or another seal layer formed on the second receptacle block to provide sealing between opposed surfaces of the two receptacle blocks when the two divisional housings are combined together, wherein the two receptacle blocks and the seal layer form, when the two divisional housings are combined together, a chamber that encloses the electric component in at least one of a dustproof or waterproof manner.

3. The power tool according to claim 2, further comprising outer surface layers of an elastic material, formed on outer surfaces of the two divisional housings, respectively, wherein the seal layer pierces a divisional housing from the inside of the receptacle block, and is continuously formed integrally with one of the outer surface layers formed on the divisional housing.

4. The power tool according to claim 3, wherein the seal layer is continuously formed integrally with one of the outer surface layers formed on the outer surfaces of the two divisional housings, by double molding.

5. The power tool according to claim 3, wherein the elastic material of which the outer surface layers is formed is elastomer.

6. The power tool according to claim 2, wherein the second receptacle block includes a rib having an end face configured to be opposed to the seal layer formed on the first receptacle block and to receive the seal layer formed on the first receptacle block that is pressed against the rib when the two divisional housings are combined together.

7. The power tool according to claim 2, wherein the seal layer has a recess in which the electric component is installable.

8. The power tool according to claim 7, wherein the second receptacle block includes a rib having an end face configured to be opposed to the seal layer formed on the first receptacle block and to receive the seal layer formed on the first receptacle block that is pressed against the rib when the two divisional housings are combined together; and wherein the recess and the rib form a space in which the electric component is housed when the seal layer is pressed against the rib.

9. The power tool according to claim 8, wherein the electric component includes a male connector and a female connector; and wherein at least one of the seal layer and the two receptacle blocks has a through hole by means of which the space communicates with outside and through which a lead wire connected with the male or female connector is led in from the outside.

10. The power tool according to claim 2, wherein one of the two divisional housings includes a locator ridge and another of the two divisional housings includes a locator channel; and wherein the two divisional housings are combined together by engaging the locator ridge and the locator channel with each other.

11. The power tool according to claim 2, wherein the seal layer includes a first seal layer formed on the first receptacle block and a second seal layer formed on the second receptacle block, and wherein the first and second seal layers are configured to be pressed against each other when the two divisional housings are combined together.

12. The power tool according to claim 11, wherein the first and second seal layers have first and second recesses, respectively, the first and second recesses form a space in which the electric component is housed when the first and the second seal layers are pressed against each other.

13. The power tool according to claim 12, wherein one of the first and second seal layers includes a step portion contiguous with an edge of the corresponding recess, the step portion extending parallel to one of the opposed surface of the first or second receptacle block on which the other of the first and second seal layers is formed, and configured to receive the other of the first and second seal layers that is pressed against the step portion when the two divisional housings are combined together.

14. The power tool according to claim 12, wherein the electric component includes a male connector and a female connector, and wherein the seal layer has a through hole by means of which the space communicates with outside and through which a lead wire connected with the male or female connector is led in from the outside.

15. The power tool according to claim 2, wherein the electric component includes a male connector and a female connector.

16. A power tool comprising:

a housing composed of two divisional housings to be combined together;

two receptacle blocks provided on inner surfaces of the two divisional housings, respectively, and configured to protrude opposite to each other from the inner surfaces of the two divisional housings to surround an electric component and to hold the electric component in place when the two divisional housings are combined together into the housing; and a seal layer of an elastic material, formed integrally with one or each of the two receptacle blocks, wherein the seal layer formed on a first receptacle block is pressed against a second receptacle block or another seal layer formed on the second receptacle block to provide sealing between opposed surfaces of the two receptacle blocks when the two divisional housings are combined together, wherein the seal layer includes a first seal layer formed on the first receptacle block and a second seal layer formed on the second receptacle block, and wherein the first and second seal layers are configured to be pressed against each other when the two divisional housings are combined together.

17. The power tool according to claim 16, wherein the first and second seal layers have first and second recesses, respectively, the first and second recesses form a space in which the electric component is housed when the first and the second seal layers are pressed against each other.

18. The power tool according to claim 17, wherein one of the first and second seal layers includes a step portion contiguous with an edge of the corresponding recess, the step portion extending parallel to one of the opposed surface of the first or second receptacle block on which the other of the first and second seal layers is formed, and configured to receive the other of the first and second seal layers that is pressed against the step portion when the two divisional housings are combined together.

19. The power tool according to claim 17, wherein the electric component includes a male connector and a female connector, and wherein the seal layer has a through hole by means of which the space communicates with outside and through which a lead wire connected with the male or female connector is led in from the outside.

* * * * *